US012729477B2

(12) United States Patent
Leibman et al.

(10) Patent No.: US 12,729,477 B2
(45) Date of Patent: Sep. 8, 2026

(54) LAUNDRY APPLIANCE AND DRAIN PUMP HOUSING

(71) Applicant: Haier US Appliance Solutions, Inc., Wilmington, DE (US)

(72) Inventors: Alexander B. Leibman, Prospect, KY (US); Sanjay Yadav Majjath, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 106 days.

(21) Appl. No.: 18/667,304

(22) Filed: May 17, 2024

(65) Prior Publication Data

US 2025/0354320 A1 Nov. 20, 2025

(51) Int. Cl.

| | |
|---|---|
| ***D06F 39/08*** | (2006.01) |
| ***F04D 13/06*** | (2006.01) |
| *D06F 103/14* | (2020.01) |
| *D06F 105/08* | (2020.01) |

(52) U.S. Cl.

CPC ..... *D06F 39/085* (2013.01); *F04D 13/06* (2013.01); *D06F 2103/14* (2020.02); *D06F 2105/08* (2020.02)

(58) Field of Classification Search

CPC .... F04D 13/06; D06F 39/085; D06F 2103/14; D06F 2105/08

See application file for complete search history.

(56) References Cited

U.S. PATENT DOCUMENTS

| | | | | |
|---|---|---|---|---|
| 6,481,246 | B1 * | 11/2002 | Johnson | D06F 39/085 68/12.02 |
| 11,530,505 | B2 | 12/2022 | Scheckelhoff et al. | |
| 11,530,506 | B2 | 12/2022 | Liu et al. | |
| 2002/0048513 | A1 * | 4/2002 | Kleemann | D06F 39/04 415/175 |
| 2007/0113595 | A1 * | 5/2007 | Harwood | D06F 39/087 68/12.01 |
| 2012/0167931 | A1 * | 7/2012 | Park | D06F 39/083 134/186 |
| 2013/0153052 | A1 * | 6/2013 | Dewsnap | F16L 55/00 137/315.01 |
| 2014/0000664 | A1 * | 1/2014 | Badafem | D06F 39/085 417/44.1 |
| 2019/0323162 | A1 * | 10/2019 | Jung | D06F 33/36 |

(Continued)

FOREIGN PATENT DOCUMENTS

| | | | |
|---|---|---|---|
| CN | 87207377 | U | 4/1988 |
| CN | 208055684 | U | 11/2018 |

(Continued)

*Primary Examiner* — Joseph L. Perrin

(74) *Attorney, Agent, or Firm* — Dority & Manning, P.A.

(57) ABSTRACT

A laundry appliance includes a drain pump housing positioned in fluid communication with a tub mounted within an interior of a cabinet. The housing has a unitary, monolithic structure including a synthetic rubber material. The housing has a first opening, a second opening, and an interior wall forming a plenum positioned fluidly between the first opening and the second opening. The interior wall extends in spiral arrangement relative to a centerline axis around an impeller positioned in the plenum. A pump assembly includes the impeller rotatably coupled to a driveshaft. The impeller and driveshaft are rotatable relative to the centerline axis.

13 Claims, 6 Drawing Sheets

(56) References Cited

U.S. PATENT DOCUMENTS

| | | | | |
|---|---|---|---|---|
| 2020/0217003 | A1* | 7/2020 | Hussain | F04D 13/06 |
| 2022/0236093 | A1* | 7/2022 | Yin | F04B 9/10 |
| 2022/0307517 | A1* | 9/2022 | Peterson | F04B 43/026 |

FOREIGN PATENT DOCUMENTS

| | | | | |
|---|---|---|---|---|
| CN | 209430402 | U | 9/2019 | |
| CN | 215805420 | U | 2/2022 | |
| CN | 216124391 | U | 3/2022 | |
| EP | 0626477 | A1 * | 11/1994 | D06F 39/10 |

* cited by examiner

LAUNDRY APPLIANCE AND DRAIN PUMP HOUSING

FIELD OF THE INVENTION

The present subject matter relates generally to laundry appliances.

BACKGROUND OF THE INVENTION

Laundry appliances, such as washing appliances or combination washer/dryer appliances include a drum and a basket at which laundry articles are positioned for wash or dry. The basket is configured to rotate within the drum, such as for performing a wash cycle (e.g., wash, rinse, spin, etc.) or a dry cycle. Wash fluid at the drum is provided for cleaning laundry articles. Wash and rinse fluid is drained at various stages of the wash cycle. Pumps may generally be utilized to urge fluid from the drum. However, known components and interfaces may be large, having undesired weight and complexity, or prone to leakage.

As such, a laundry appliance, and a drain housing therefor, addressing one or more of the aforementioned issues would be advantageous and beneficial.

BRIEF DESCRIPTION OF THE INVENTION

Aspects and advantages of the invention will be set forth in part in the following description, or may be obvious from the description, or may be learned through practice of the invention.

An aspect of the present disclosure is directed to a laundry appliance having a cabinet defining an interior, a tub mounted within the interior of the cabinet, a laundry basket rotatably mounted within the tub, in which the laundry basket defining a chamber for the receipt of laundry articles, a pump assembly and a drain pump housing. The pump assembly includes an impeller rotatably coupled to a driveshaft. The impeller and driveshaft are rotatable relative to a centerline axis. The impeller is positioned in the plenum. The drain pump housing is positioned in fluid communication with the tub. The housing has a unitary, monolithic structure including a synthetic rubber material. The housing includes a first opening, a second opening, and an interior wall forming a plenum positioned fluidly between the first opening and the second opening. The interior wall extends in spiral arrangement relative to the centerline axis around the impeller positioned in the plenum.

An aspect of the present disclosure is directed to a drain pump housing for a washing machine appliance. The housing has a unitary, monolithic structure formed completely from a synthetic rubber material. The housing includes a first opening, a second opening, and an interior wall forming a plenum positioned fluidly between the first opening and the second opening. The interior wall extends in spiral arrangement relative to a centerline axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
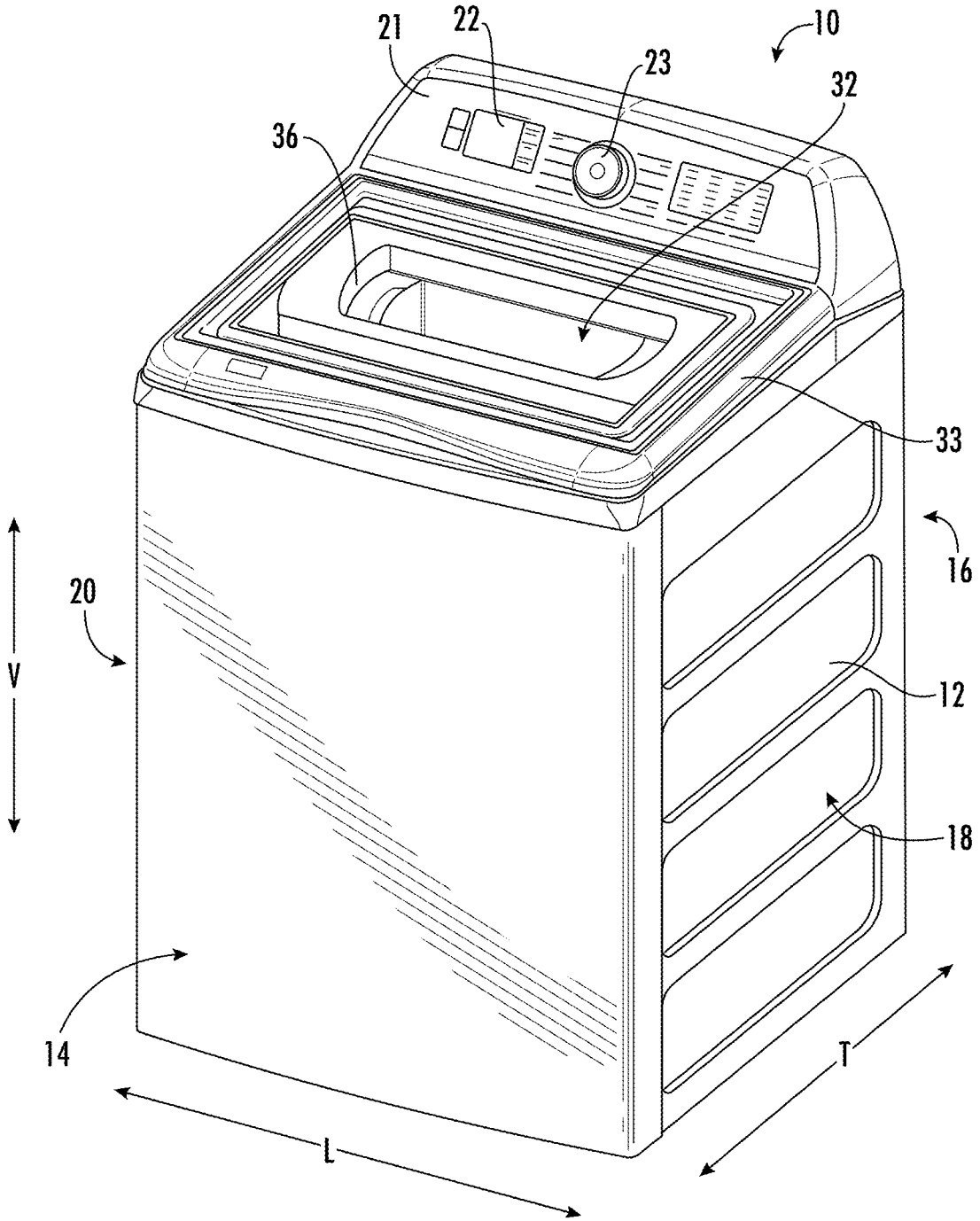
FIG. 1 provides a perspective view of a laundry appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
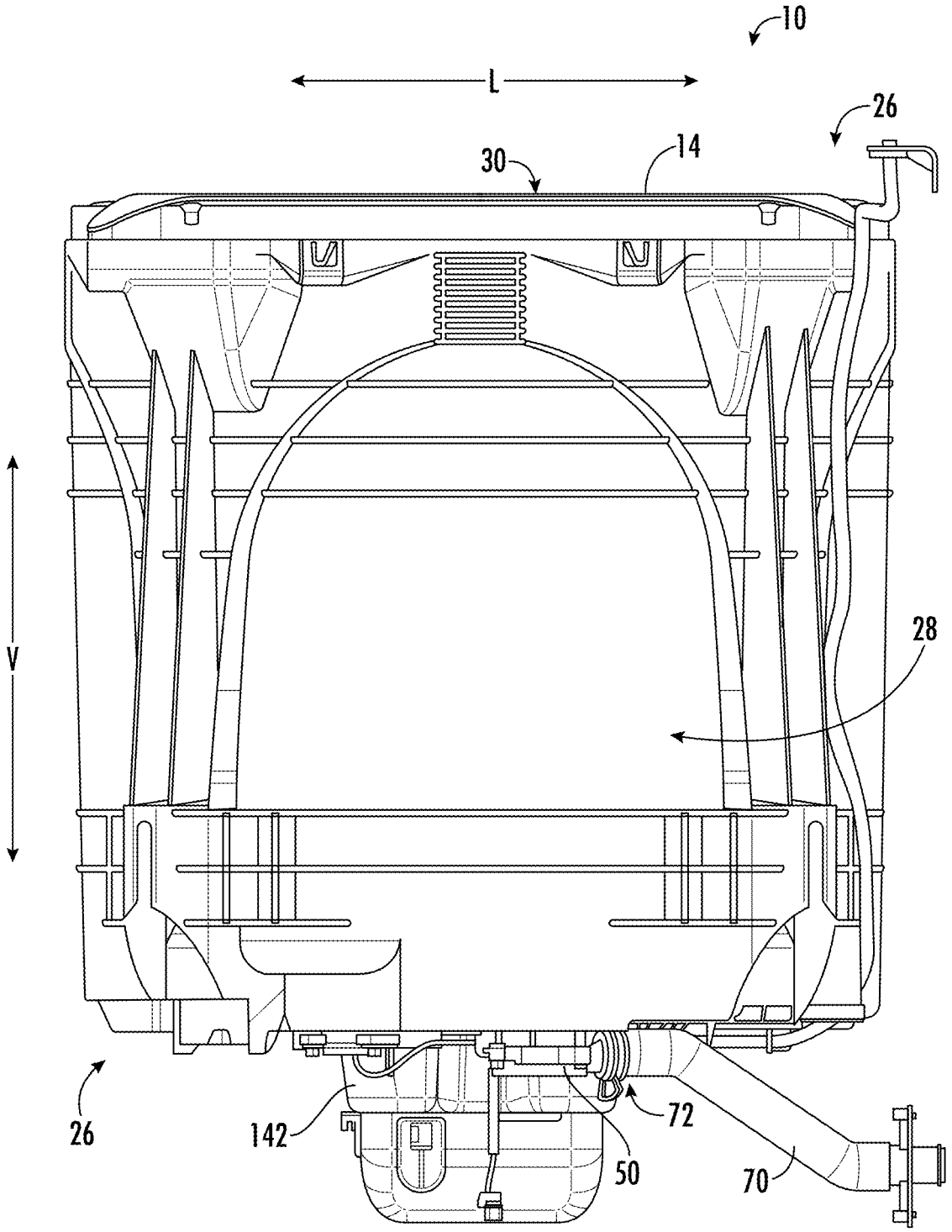
FIG. 2 provides a side view of portion of an exemplary laundry appliance in accordance with embodiments of the present disclosure.

Turning now to the figures, FIG. 1 provides a perspective view of a laundry appliance 10 according to exemplary embodiments of the present disclosure. The laundry appliance 10 is washing machine appliance. However, it should be appreciated that laundry appliance 10 may include a combination laundry appliance, and may also be referred to as a multifunction laundry appliance or washer/dryer combination appliance. FIG. 2 provides a section view of laundry appliance 10. The laundry appliance 10 generally defines a vertical direction V, a lateral direction L, and a transverse direction T, each of which is mutually perpendicular, such that an orthogonal coordinate system is defined. While described in the context of a specific embodiment of laundry appliance 10, using the teachings disclosed herein, it will be understood that laundry appliance 10 is provided by way of example only. Other laundry appliances having different appearances and different features may also be utilized with the present subject matter as well.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

Cabinet 12 includes a front panel 14, a rear panel 16, a side panels 18, 20 spaced apart from each other by front and rear panels 14 and 16. As used herein, terms such as "left" and "right" or "front" and "back" refer to directions from the perspective of a user facing the laundry appliance 10 for accessing and/or operating the laundry appliance 10. For example, a user stands in front of the laundry appliance 10, e.g., at or near the front panel 14, to access door 33 and/or inputs 23. Within cabinet 12, an interior volume is defined at which a drum or tub 26 is mounted. FIG. 2 depicts an embodiment of the tub 26 with the cabinet removed for clarity.

A laundry basket (not depicted) is mounted within the tub 26. The laundry basket defines a chamber for receipt of articles of clothing for treatment, e.g., washing, rinsing, spinning, tumbling, and/or drying, such as may generally be understood.

In some embodiments, one or more selector inputs 23, such as knobs, buttons, touchscreen interfaces, etc., may be provided or mounted on the cabinet 12, e.g., on a control panel 21 thereof and are in operable communication (e.g., electrically coupled or coupled through a wireless network band) with a processing device or controller. The control panel 21 may also include a display 22. The controller may also be provided in operable communication with various components of the washer/dryer appliance 10, such as the motor, blower, and/or drying system. In turn, signals generated in the controller direct operation of such components in response to the position of inputs 23. As used herein, "processing device" or "controller" may refer to one or more microprocessors, microcontroller, ASICS, or semiconductor devices and is not restricted necessarily to a single element. The controller may be programmed to operate laundry appliance 10 by executing instructions stored in memory (e.g., non-transitory media). The controller may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

Tub 26 is generally cylindrical in shape, having an outer cylindrical wall 28 and a flange or wall 30 that defines an opening 32 of tub 26 for loading and unloading of articles into and out of a chamber defined by and within a laundry basket inside of the tub 26. A door 33 provides for closing or accessing tub 26 through opening 32. A window 36 (FIG. 1) may be provided in door 33 for viewing of the chamber 25 and/or laundry articles therein, e.g., during operation of the laundry appliance 10.

A laundry basket is rotatably mounted within tub 26 such that the laundry basket is rotatable about an axis of rotation CL, such as may generally be understood. Laundry appliance 10 includes a motor assembly (not shown) that is in mechanical communication with laundry basket to selectively rotate laundry basket. The motor assembly may be any suitable type, size, or configuration of motor used to rotate the laundry basket.

Figure 3:
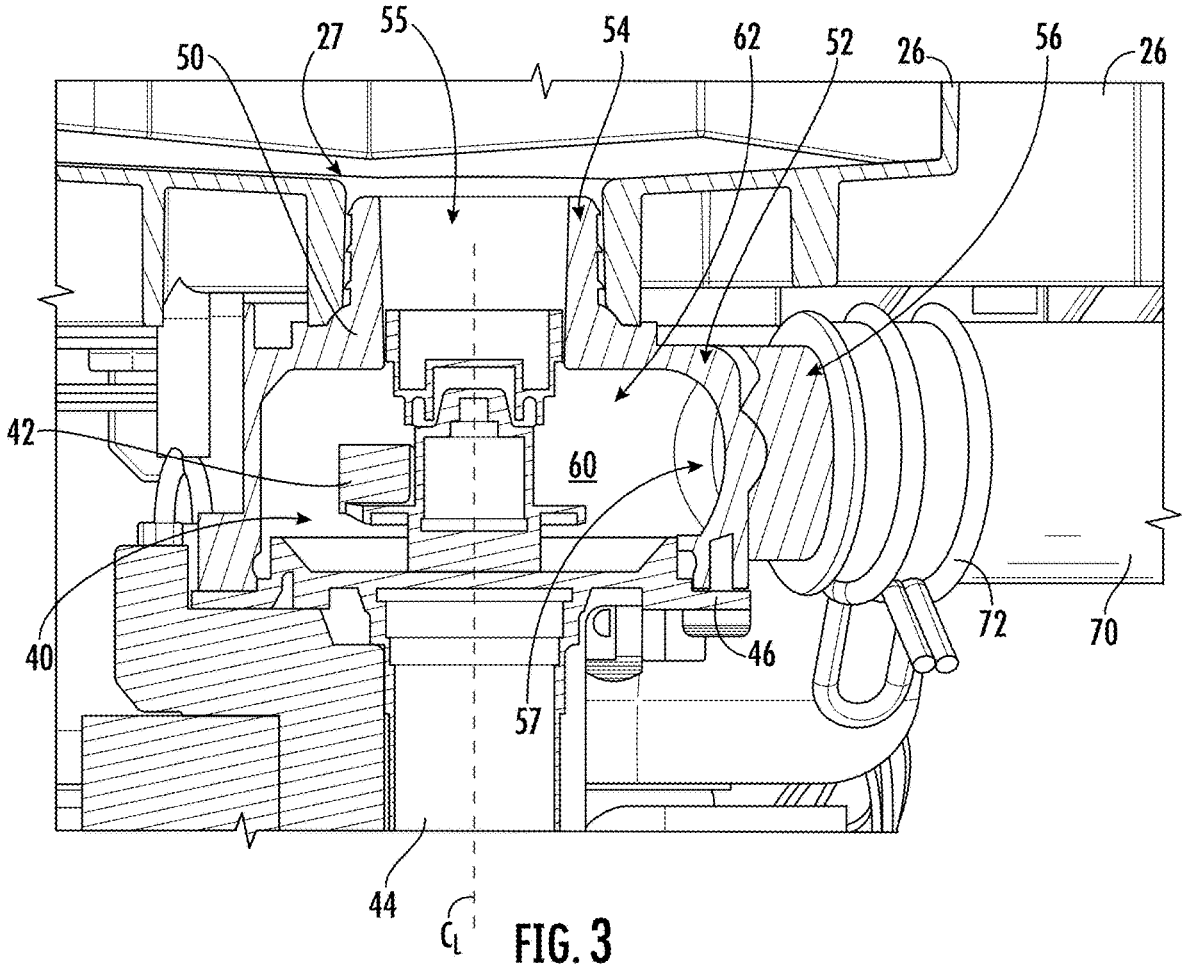
FIG. 3 provides a cutaway view of a drain pump shroud for a laundry appliance in accordance with embodiments of the present disclosure.

Referring to FIGS. 2-3, a sump 142 may be positioned at a bottom of the tub 26 along the vertical direction V. For instance, sump 142 may configured for receipt of, and generally collects, wash liquid (the wash liquid may include, e.g., water, or water-based solution such as may also include additives such as detergents, etc.) during wash operations of laundry appliance 10. For example, during a wash operation of laundry appliance 10, wash liquid may be urged (e.g., by gravity) from the chamber within the laundry basket to sump 142. A pump assembly 40 is located beneath tub 26 for gravity assisted flow when draining tub 26 (e.g., via a drain 41). Pump assembly 40 may also be configured for recirculating wash liquid within tub 26.

In exemplary embodiments, during operation of laundry appliance 10, laundry items are loaded into the laundry basket at the tub 26 through opening 32, and an operation is initiated through operator manipulation of input selectors 23. For example, a wash cycle may be initiated such that tub 26 is filled with water, detergent, or other fluid additives. One or more valves (not shown) can be controlled by the laundry appliance 10 to provide for filling the laundry basket to the appropriate level for the amount of articles being washed or rinsed, such as may generally be understood.

During, or after, various phases of a wash cycle (e.g., after an agitation phase, or before or after a rinse cycle, or before or after a spin cycle, etc.) the pump assembly 40 is activated to spin relative to a centerline axis CL. Pump assembly 40 includes an impeller 42 rotatably coupled to a driveshaft 44. The impeller 42 and driveshaft 44 are rotatable relative to the centerline axis CL. For instance, driveshaft 44 may extend along centerline axis CL. Impeller 42 may include blades positioned in circumferential arrangement relative to the centerline axis CL. Pump assembly 40 may further include a wall 46 configured to seal a plenum 60 at which the impeller 42 is positioned. The wall 46 is configured to abut and interface with a drain pump housing 50, such as to seal fluid within the housing 50.

Figure 4:
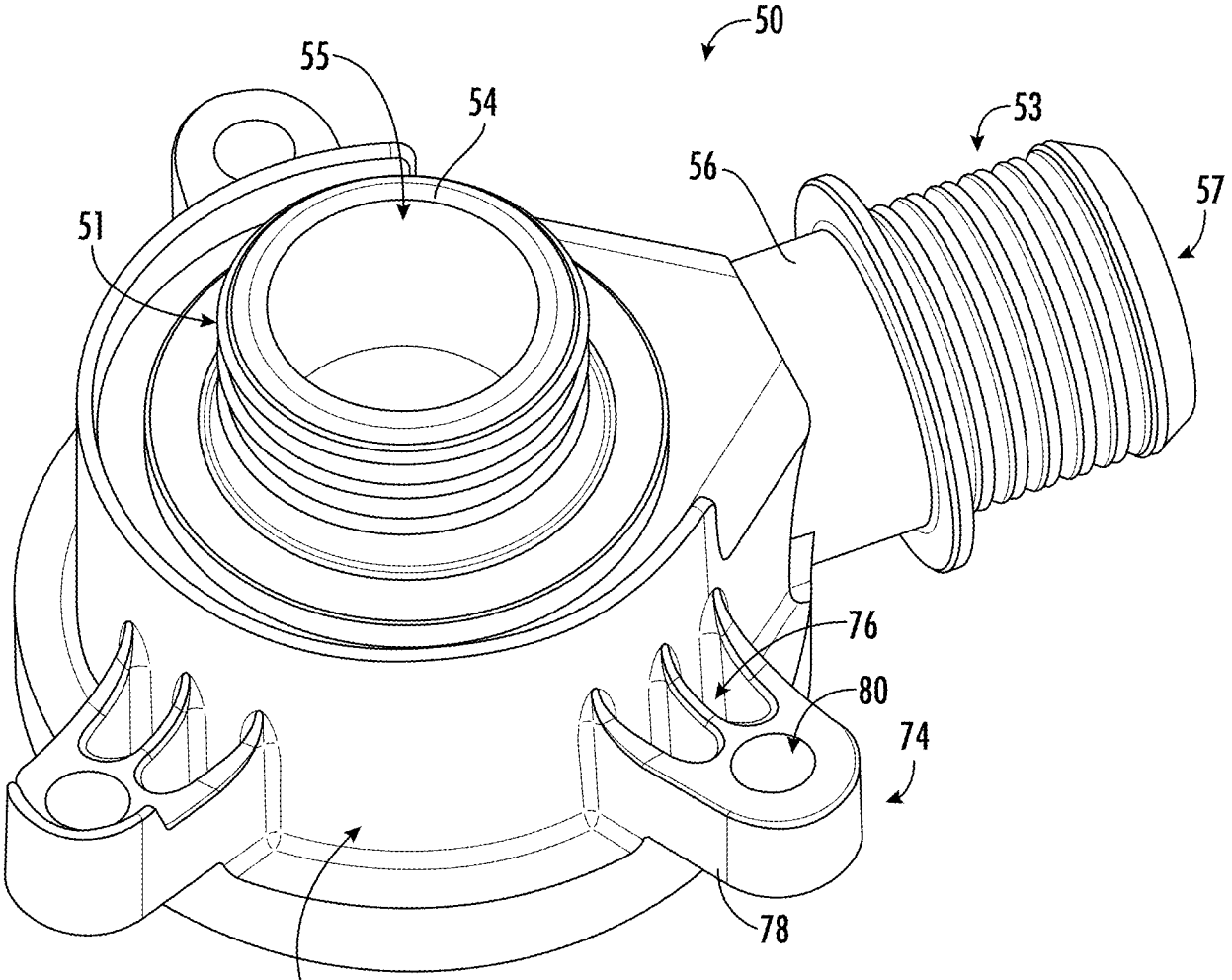
FIG. 4 provides a perspective view of a drain pump shroud for a laundry appliance in accordance with embodiments of the present disclosure.
Figure 5:
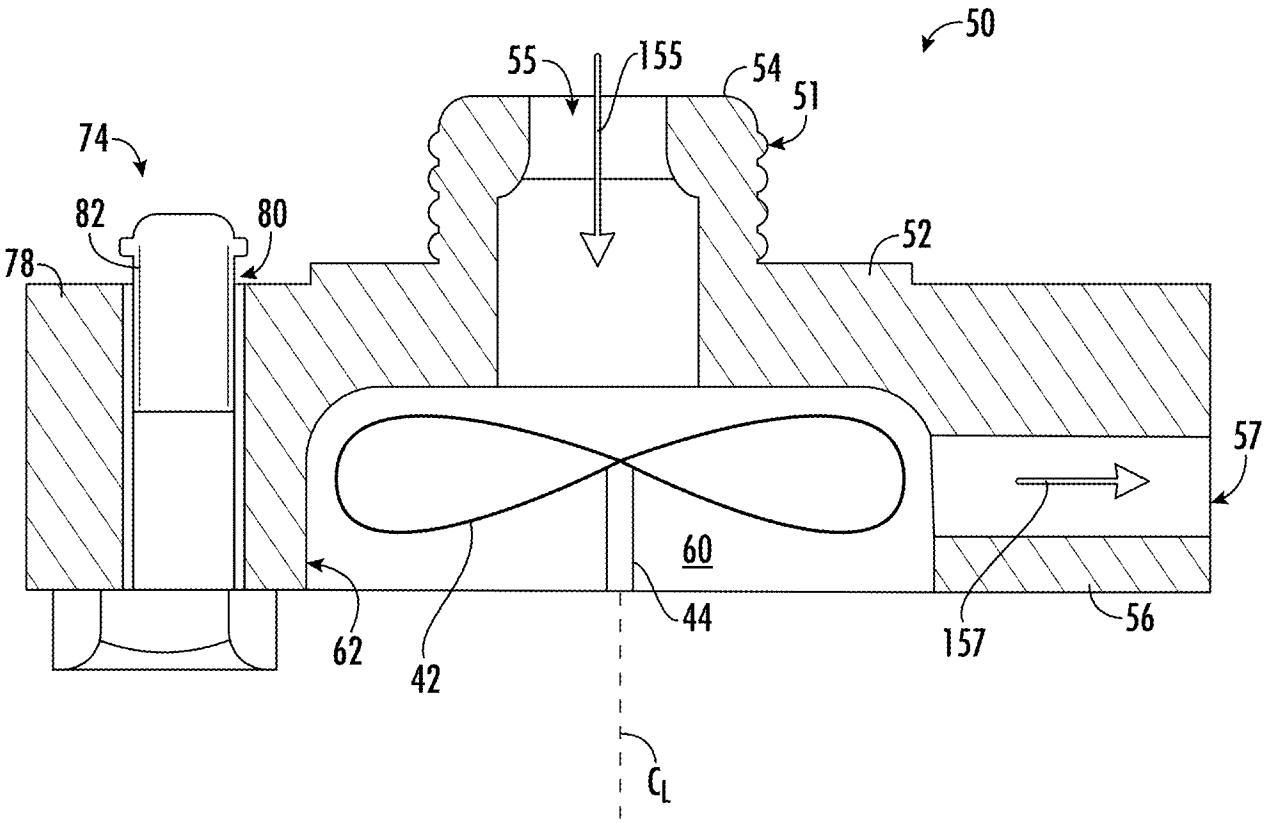
FIG. 5 provides a cross-sectional view of an exemplary drain pump shroud for a laundry appliance in accordance with embodiments of the present disclosure.
Figure 6:
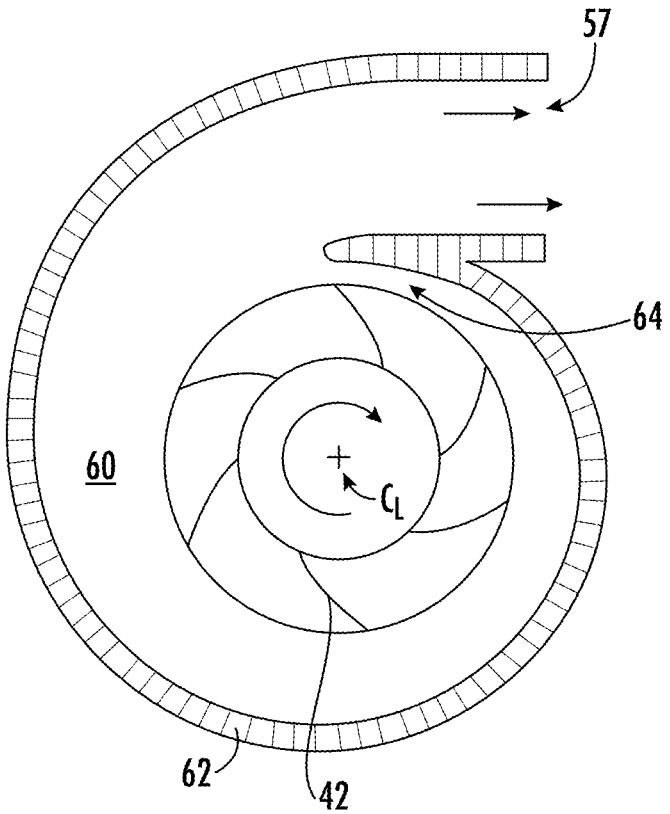
FIG. 6 provides a cross-sectional view of an exemplary drain pump shroud for a laundry appliance in accordance with embodiments of the present disclosure.

Referring to FIGS. 3-6, a drain pump housing 50 is positioned in fluid communication with the tub 26. The housing 50 includes a body 52 forming a plenum 60 at which the impeller 42 is positioned, such as depicted at FIG. 3 and FIGS. 5-6. The body 52 includes an interior wall 62 forming the plenum 60. A first opening 55 and a second opening 57 extend in fluid communication with the plenum 60. In various embodiments, the housing 50 includes a first neck 54 and a second neck 56 each extending from the body 52. The first opening 55 is formed at the first neck 54 and the second opening is formed at the second neck 56, such as to permit fluid flow into the plenum 60 and egress from the housing 50.

The interior wall 62 extends in a toroidal or spiral arrangement relative to the centerline axis CL. Referring to FIG. 6, in various embodiments, the interior wall 62 extends from the second opening 57 around the impeller 42 positioned in the plenum 60. The interior wall 62 extends substantially around the centerline axis CL. The interior wall 62 extending from the second opening 57 includes a decreasing cross-sectional flowpath area at the plenum 60 as the flowpath extends around the impeller 42. A distal end of the flowpath at the plenum from the second opening 57 60 forms a minimum flowpath area 64 or cutoff clearance. The spiral arrangement of the interior wall 62 and plenum 60 may urge fluid through the housing 50. Additionally, rotation of the impeller 42 may further urge fluid to egress through the second opening 57.

In various embodiments, a rib 51 extends from the first neck 54 to form a sealing interface at an opening 27 at the tub 26 (FIG. 3) into which the first neck 54 is extendable to provide fluid communication from the tub 26 to the housing 50. In some embodiments, such as depicted in FIG. 4, a rib 53 extends from the second neck 56 to form a sealing interface at a conduit 70 attachable to the second neck 56. The conduit 70 may form a drain hose or manifold configured to receive a flow of fluid egressing the housing 50 through the second opening 57. A clamp 72 may be utilized to secure the conduit 70 to the housing 50 at the second neck 56.

In some embodiments, the centerline axis CL extends through the first opening 55. For instance, the first opening 55 may include a channel extending substantially co-directional to an extension of the driveshaft 44. The first opening 55 and the second opening 57 may be arranged in substantially perpendicular arrangement to one another. For instance, a flow of fluid through the first opening 55, such as depicted schematically via arrows 155 in FIG. 5, may flow substantially along a first direction (e.g., vertical direction V). The spiral plenum 60 and impeller 42 urge the flow of fluid through the plenum 60 to egress through the second opening 57, such as depicted schematically via arrows 157 in FIG. 5. The flow of fluid may accordingly change directions from a first direction to a substantially perpendicularly second direction as the fluid egresses the housing 50 through the second opening 57.

The housing 50 is formed as a unitary, monolithic structure from a synthetic rubber material. In various embodiments, the synthetic rubber material is an ethylene propylene diene monomer (EPDM) material. For instance, the body 52, the first neck 54, and the second neck 56 form a single, unitary, monolithic component completely from synthetic rubber material. Interior walls 62 form the toroidal or spiral plenum 60 into which the impeller 42 is positioned. The housing 50 formed as a unitary, monolithic component of synthetic rubber material such as described herein may facilitate flow and egress of fluid from the tub 26, while further facilitating sealing of fluid within the housing 50 and between interfaces, such as a first interface at the housing 50 and tub 26, a second interface at the housing 50 and the wall 46 of the pump assembly 40, or a third interface at the housing 50 and conduit 70. The housing 50 formed such as described herein may further obviate a need for additional seals, sealing surfaces, or sealants, such as to decrease a quantity of parts, reduce assembly complexity, and improve sealing between components.

In some embodiments, the housing 50 includes a fastener mount 74 extending externally from the body 52. In some embodiments, the fastener mount 74 includes a rib structure 76 extending from the body 52 to a mount platform 78. The mount platform 78 includes a fastener opening 80 configured to receive a fastener 82 (FIG. 5). In various embodiments, fastener mount 74 is formed as a unitary, monolithic component with the body 52. The rib structure 76 may include a plurality of ribs extending from the body 52, such as to provide desired rigidity and flexibility at the mount platform 78. Fastener 82 may include a mechanical fastener, such as, but not limited to, a threaded shank (e.g., bolt and nut, screw, thread tie rod, etc.). The fastener 82 may extend through the fastener opening 80 and to the wall 46 at the pump assembly 40 to secure the pump assembly 40 to the housing 50. The synthetic rubber body 52 may further facilitate sealing the plenum 60 between the body 52 and the pump assembly 40.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance, comprising:

a cabinet defining an interior;

a tub mounted within the interior of the cabinet;

a laundry basket rotatably mounted within the tub, the laundry basket defining a chamber for the receipt of laundry articles;

a drain pump housing positioned in fluid communication with the tub, the housing comprising a unitary, monolithic structure formed completely of a synthetic rubber material, the housing comprising a first opening, a second opening, and an interior wall forming a plenum positioned fluidly between the first opening and the second opening, wherein the interior wall extends in spiral arrangement relative to the centerline axis around the impeller positioned in the plenum; and a pump assembly comprising an impeller rotatably coupled to a driveshaft, the impeller and driveshaft rotatable relative to a centerline axis, wherein the centerline axis extends through the first opening, and wherein the interior wall extends in spiral arrangement from the second opening to a minimum flowpath area, wherein the impeller is positioned in the plenum.

2. The laundry appliance of claim 1, wherein the synthetic rubber material comprises an ethylene propylene diene monomer material.

3. The laundry appliance of claim 1, wherein the housing comprises a first neck at which the first opening is formed, wherein the first neck extends from a body at which the plenum is formed.

4. The laundry appliance of claim 3, wherein the first neck comprises a rib.

5. The laundry appliance of claim 1, wherein the first neck is extendable into an opening at the tub to provide fluid communication to the drain pump housing.

6. The laundry appliance of claim 3, wherein the housing comprises a second neck at which the second opening is formed, wherein the second neck extends from the body.

7. The laundry appliance of claim 6, wherein the second neck comprises a rib.

8. The laundry appliance of claim 1, wherein the first opening and the second opening are positioned in substantially perpendicular arrangement to one another.

9. The laundry appliance of claim 1, wherein the housing comprises a fastener mount extending externally from a body.

10. The laundry appliance of claim 9, wherein the fastener mount comprises a rib structure extending from the body to a mount platform, the mount platform comprising a fastener opening configured to receive a fastener.

11. The laundry appliance of claim 1, wherein the interior wall extends in spiral arrangement relative to the centerline axis from the minimum flowpath area to the second opening forming a maximum flowpath area.

12. The laundry appliance of claim 11, wherein the second opening is positioned radially outward of the impeller relative to the centerline axis.

13. The laundry appliance of claim 12, wherein the minimum flowpath area is positioned radially inward of the second opening such that the interior wall separates the second opening from the minimum flowpath area.

* * * * *